US005171209A

United States Patent [19]

Gamba

[11] Patent Number: 5,171,209

[45] Date of Patent: Dec. 15, 1992

[54] DYNAMIC SUPPORT FOR PREVENTING BACK-ACHE IN A SITTING POSITION

[75] Inventor: Eugenio Gamba, Milan, Italy

[73] Assignee: GE 2 s.r.l., Milan, Italy

[21] Appl. No.: 831,043

[22] Filed: Feb. 4, 1992

[30] Foreign Application Priority Data

Feb. 6, 1991 [IT] Italy ..... MI91-U/000095

[51] Int. Cl.[5] ..... A61F 5/00

[52] U.S. Cl. ..... 602/13; 602/19

[58] Field of Search ..... 602/12, 19, 23, 36; 128/870, 875, DIG. 20; 5/634, 644, 653; 297/284 E, 460, DIG. 3

[56] References Cited

U.S. PATENT DOCUMENTS

| | | | |
|---|---|---|---|
| 3,050,748 | 8/1962 | Deutinger | 5/644 |
| 3,145,054 | 8/1964 | Sopko | 297/284 E |
| 3,326,601 | 6/1967 | Vanderbilt | 297/284 E |
| 4,120,297 | 10/1978 | Rabischong | 602/19 |
| 4,175,297 | 11/1979 | Robbins | 297/DIG. 3 |
| 4,178,922 | 12/1979 | Curlee | 602/19 |
| 4,178,923 | 12/1979 | Curlee | 602/19 |
| 4,759,543 | 7/1988 | Feldman | 297/DIG. 3 |
| 4,965,899 | 10/1990 | Sekido | 297/DIG. 3 |
| 5,020,517 | 6/1991 | Foster | 297/DIG. 3 |
| 5,062,414 | 11/1991 | Grim | 602/19 |

FOREIGN PATENT DOCUMENTS

| | | |
|---|---|---|
| 0113613 | 7/1984 | European Pat. Off. . |
| 2074034A | 10/1981 | United Kingdom . |
| 2243292A | 10/1991 | United Kingdom . |

*Primary Examiner*—Michael A. Brown

*Attorney, Agent, or Firm*—Jacobson, Price, Holman & Stern

[57] ABSTRACT

The dynamic support (1) comprises means (3) for the cyclic inflation and deflation of an air chamber (2). The air chamber (2) is divided into two half-chambers (2A) having a common rigid laminar element (4) to be positioned on a seat back. When the half-chambers (2A) are inflated they press mainly against the muscular tissue of the lumbar region of the user's back, with the exception of his vertebrae and ribs.

16 Claims, 3 Drawing Sheets

Fig.1
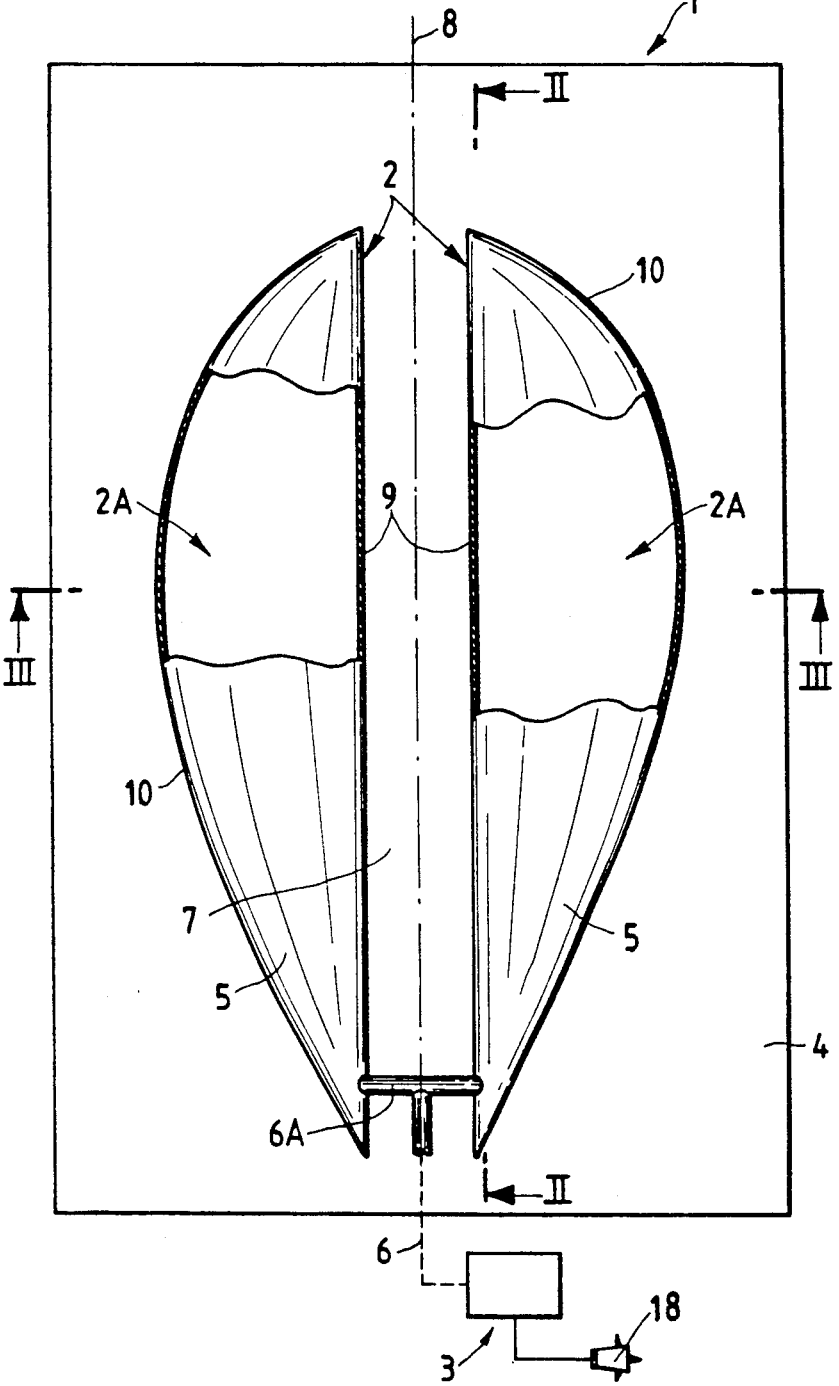
Fig.2
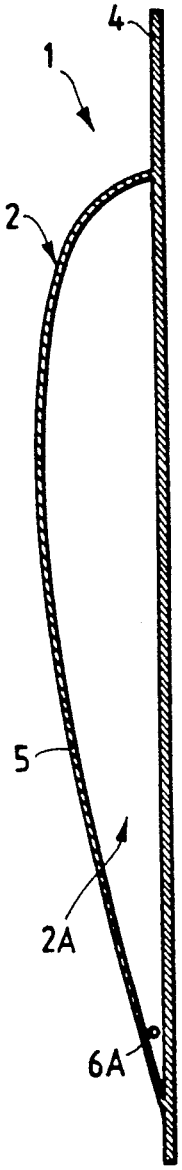
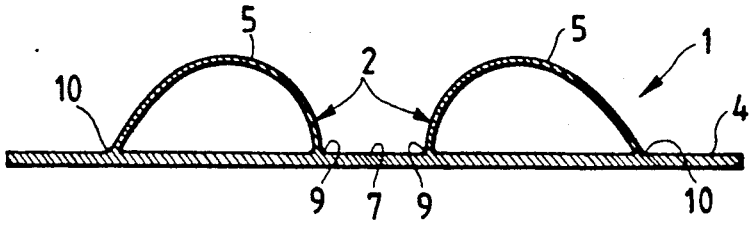
Fig.3

Fig.4
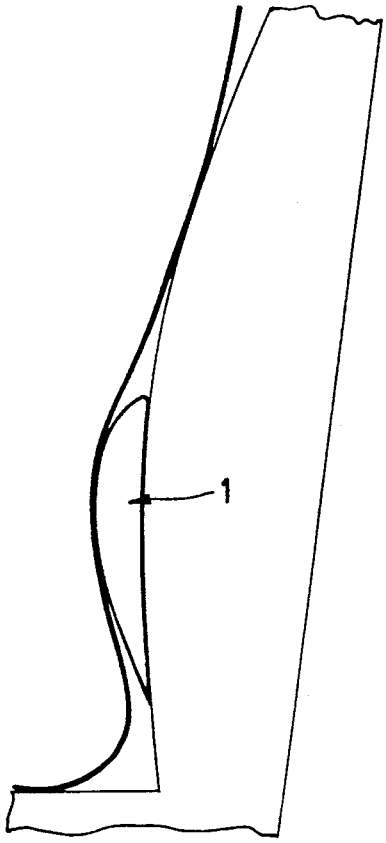
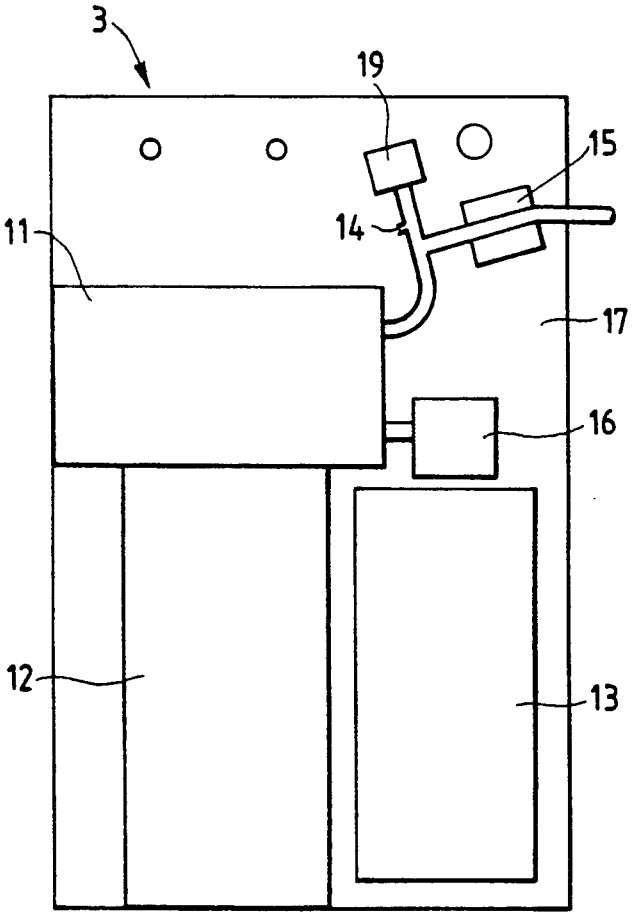
Fig.5

DYNAMIC SUPPORT FOR PREVENTING BACK-ACHE IN A SITTING POSITION

This invention relates to an improved dynamic support for preventing back-ache in a sitting position.

Back-ache is a disturbance which usually affects persons obliged to assume a substantially immobile position for a tendentially lengthy period.

Persons who for example sit at the steering wheel of a vehicle for a lengthy period are particularly prone to this.

The use of anatomical seats or devices for fitting to seats in general to make them anatomical improves the situation without however satisfactorily solving the problem.

Devices known as dynamic supports are also available.

Cyclically inflating the air chamber of such devices stresses the user's back, which is urged to vary its position. As the back does not remain long in the same position, it is less subject to back-ache than previously. Although these devices give better results than conventional anatomical seats, they still do not satisfactorily solve the problem because they generate on the back only a generic thrust which does not take account of its actual shape or of the shape of the seat on which they are installed. In this respect, the yieldability of the seat, or rather of the seat back, absorbs by reaction a part of the necessary deformation. Correct operation of the device is therefore substantially conditional on the characteristics of the seat back. In the current state of the art, depending on the characteristics and dimensions of the seat and the device, either the thrust generated by the air chamber on the user's back is irrelevant from the therapeutic aspect because it is substantially absorbed by the yieldability of the seat, or it tends to cause the user to slide outwards from the seat, so being a source of annoyance. An object of the present invention is to obviate the aforesaid drawbacks by providing a device able to generate a thrust administered in such a manner as to cause the muscles and vertebrae to undergo correct movement without the seat structure being able to influence the functionality of the device and without causing the user to slide outwards.

This object is attained by an improved dynamic support for preventing back-ache in a sitting position, comprising an air chamber to be interposed between the seat and the user's back, and inflation means and deflation means which can be associated with said air chamber, characterised in that the air chamber is associated with a rigid laminar element and comprises a laminar element of non-rigid material which makes contact with the user's back, said air chamber being divided into two spaced-apart half-chambers situated on opposite sides of a common longitudinal axis. During the inflation of the air chamber the same force constantly presses both against the seat back and against the user's back because of the action-reaction principle.

However the presence of the rigid laminar element transforms this force into a uniform pressure acting on the seat back which is only of limited extent. The seat back therefore undergoes no substantial deformation even if it has a particularly soft structure.

The non-rigid material, which is of greater area, inflates to assume a convex configuration to therefore press against the muscles with a surface area which is suitably less than that of the rigid laminar element. Consequently the device acts on the muscles with a pressure suitably greater than that transmitted to the seat back, but without being influenced by the yieldability of this latter. Effective movement of the muscles and consequently of the connected vertebrae is therefore obtained.

The user is prevented from slipping as a result of the thrust generated by the air chamber because the air chamber, or rather the half-chambers, act only on the muscles which, being yieldable, adapt to the increase in volume of the half-chambers by moving relative to each other, without however causing the user's body to move. Consequently the individual vertebrae of the vertebral column also move relative to each other, but without necessarily causing the entire vertebral column and hence the user's body to move outwards.

The vertebral column is therefore not subjected directly to any action because it rests in the space between the half-chambers. Consequently there is no overall movement of the user's body relative to the seat.

In this respect, if the vertebral column were instead to be directly stressed, in particular in its sacral region, it would be able, because of its structure, to transmit the movement impressed on it in a substantially unaltered manner to the user's body, which would consequently slide outwards from the seat. Provided the aforesaid technical characteristics are satisfied, the configuration of the air chamber can be varied at will to provide half-chambers of different shape and dimensions to satisfy any particular therapeutic requirements connected with thrust distribution, with anatomy, with body size or with a combination of these. Likewise the rigid laminar element can be of different size or shape, depending on the seat back for which it is intended.

The invention is illustrated by way of non-limiting example in the figures of the accompanying drawings.

FIG. 1 is a front view of the air chamber of the dynamic support according to the invention, in its inflated state;

FIG. 2 is a section on the line II—II of FIG. 1;

FIG. 3 is a section on the line III—III of FIG. 1;

FIG. 4 is a schematic sectional view showing the position of the support relative to the user's back;

FIG. 5 is a schematic view of the inflation and deflation means of the device;

Figure 6:
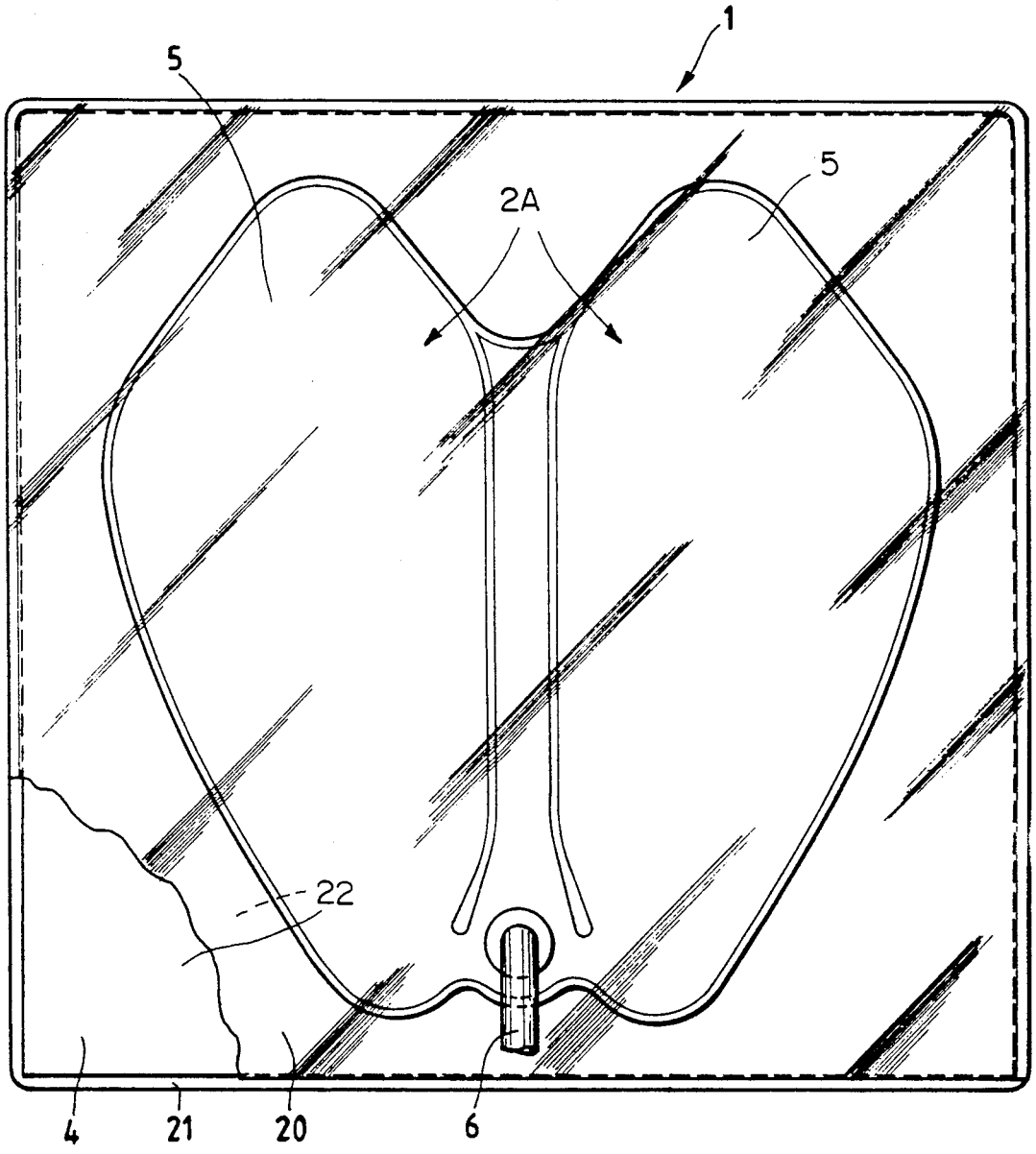
FIG. 6 shows an alternative embodiment of the air chamber.

With reference to said figures, the improved dynamic support 1 comprises an air chamber 2, inflation means 14.3 and deflation means 14.

The air chamber 2 comprises a rigid laminar element 4 to which a non-rigid laminar element 5 adheres under hydraulically sealed conditions.

The bond is formed preferably by vulcanization. The non-rigid element 5 has a greater area than that portion of the rigid laminar element 4 which it subtends, so that it can withdraw from it to form a space for the air fed by the means 3 via the tube 6. The tube 6 is provided with a branch 6A which connects together the two half-chambers 2A into which the air chamber 2 is divided. The two half-chambers 2A are separated by a space 7 extending about the longitudinal axis 8 of the air chamber 2.

In the preferred embodiment the lines 9 along which the laminar elements are joined together and which define the space 7 are straight or substantially straight.

Each first joining line 9 of the half-chamber 2A meets at its ends a second arched joining line 10. The known shape which most approximates to that of the lines 10 shown in the example is the ogive.

The correct operation of the device can be facilitated in certain cases by using other shapes, such as those shown for example in FIG. 6, provided that independently of these shapes the resultant half-chambers present their minimum inflation and hence minimum thickness in the sacral region and their maximum thickness in the lumbar region, and that they are such as not to create any point of pressure or of concentrated bearing on the vertebral spinal apophyses to prevent the risk of local periosteal irritation.

The maximum correction thrust must act on the muscles and not beyond the level of the second lumbar vertebra, taking care not to negatively stimulate the final ribs.

The non-rigid laminar element 5 is of elastic material both to provide the half-chambers with a residual capacity to adapt to the seated person's back should he himself move to find the most accommodating position, and also to allow the air contained in the more greatly compressed half-chamber 2A to progressively transfer to the other half-chamber, via the mutual connection. As this latter half-chamber 2A has at least one elastic wall it can readily and easily accommodate the transferred air.

The material of the non-rigid laminar element 5 is preferably neoprene, synthetic or natural rubber, and can be covered with a layer of antidecubitis material. This can for example be particularly useful where the device is intended to alleviate the suffering of persons not necessarily driving a vehicle but in any event obliged to remain substantially immobile.

The rigid laminar element 4 can be provided with means for its securing to the seat to prevent it moving during operation. Various methods can be used for this, depending on the seat dimensions and model.

By way of example, in the case shown in FIG. 6 the rigid laminar element 4 is housed within a pocket 22 defined by joining a second laminar element 20 to a third laminar element 21. The second laminar element 20 is also joined to the first non-rigid laminar element 5 with a hydraulic seal to form the half-chambers 2A. The pocket 22 allows easy replacement or addition of the rigid laminar elements 4, which can differ in shape, dimensions and rigidity. In this manner the device becomes particularly versatile and hence easily adaptable to user requirements and to the seat characteristics.

The inflation means 3 (see FIG. 5), with the air chamber 2 inflated, operates cyclically and comprises at least one pump 11 driven at a preselected rate by an electric motor 12 controlled by a timer 13. The deflation means comprise at least one cabilerated or sized hole 14 which allows a continuous outflow rate of fluid from the air chamber 2 which is less than the inflow rate of fluid provided by the pump 11, with the hole preferably positioned in the delivery tube from the pump 11, which can also be of a reversible type. The means 14 could be provided in the air chamber 2 in view of its simplicity.

If it is desired to heat the air fed into the air chamber 2, heating means 15, possibly temperature-controlled, are provided downstream of the pump 11. Heating the air has the double advantage of increased comfort during winter periods and increased therapeutic effect of the device by heating the muscles. A safety valve 19 is also connected to the delivery tube to prevent overpressure being produced within the dynamic support which would be dangerous for the device and in particular for the air chamber 2.

An air filter 16 is connected to the suction side of the pump 11 to prevent the entry of impurities.

In the illustrated example the inflation means 3, the deflation means 14 and the relative accessories are all housed in a single casing 17 of pocket dimensions.

The miniaturization of said means is particularly facilitated by the fact that the pump 11 and the electric motor 12 are combined into a single block and the deflation means 14 are formed by the sized hole 14 instead of a solenoid valve as is usually the case in conventional devices.

The provision of a hole instead of a solenoid valve makes the device 1 both economical and reliable. In this respect, the cost of the solenoid valve and the cost involved in its installation and its timing circuit are saved. The reliability derives from the fact that a sized hole is substantially not subject to wear, in contrast to a solenoid valve.

During operation, the inflation means 3 is made to feed air periodically because in the illustrated case these means have a greater capacity than the deflation means 14, which consequently operate virtually continuously to allow correct execution of the cycle. In this manner the cycle can be adjusted at will merely by regulating the timer 13 which controls the motor 12.

Preferably the inflation means 3 operate for four minutes and are at rest for one minute.

In the particular case in which the support 1 is of the type suitable for installation on seats of automobiles or of vehicles in general, the electrical energy required for operating the motor 12 can be provided directly by the system on board, using an electrical plug 18 for example of the type which can be inserted into a conventional cigarette-lighter dashboard socket.

I claim:

1. A dynamic support device for supporting the back of a user in a sitting position, which comprises:

means for supporting the back of the user relative to a seat member, said support means including inflatable air chamber means for contacting the back of the user;

deflating means in communication with said air chamber means for permitting continuous deflation of said air chamber means at a first preselected rate;

inflating means for reinflating said air chamber means at periodic intervals, at a second different preselected rate, said continuous preselected deflation rate being less than said periodic reinflation rate so that said air chamber means is alternately partially deflated and then reinflated to essentially an original inflated condition; and timing means for energizing said inflating means at the periodic intervals.

2. The dynamic support device as claimed in claim 1, which further comprises air heating means provided downstream of said air chamber means for heating air provided to said air chamber means by said inflating means.

3. The dynamic support device as claimed in claim 1, which further comprises a safety valve connected to a pump delivery tube of said inflating means.

4. The dynamic support device as claimed in claim 1 wherein the inflating means comprises a pump driven by an electric motor controlled by said timing means, with the deflating means comprising a sized hole provided in a pump delivery tube.

5. The dynamic support device as claimed in claim 4, which further comprises an air filter connected to a suction side of said pump.

6. The dynamic support device as claimed in claim 4, wherein the inflating means and the deflating means are housed in a single casing of pocket size.

7. The dynamic support device as claimed in claim 4, wherein the pump is of a reversible type.

8. The dynamic support device as claimed in claim 1, wherein said deflating means is a continuously open, calibrated hole in fluid communication with said air chamber means.

9. The dynamic support device as claimed in claim 1, which further comprises rigid support means for supporting said air chamber means.

10. The dynamic support device as claimed in claim 1, wherein said air chamber means comprises two spaced-apart air chambers situated on opposite sides of a common longitudinal axis.

11. The dynamic support device as claimed in claim 10, wherein said air chamber means further comprises a first rigid laminar element, a second non-rigid laminar element and third and fourth laminar elements, said second non-rigid laminar element and said third element defining the two spaced-apart air chambers, and said third and fourth laminar elements defining a pocket for housing the first rigid laminar element.

12. The dynamic support device as claimed in claim 10, wherein said spaced-apart air chambers are essentially half-chambers of the same size.

13. The dynamic support device as claimed in claim 10, wherein said spaced-apart air chambers are formed by a pair of non-rigid laminar elements joined to a rigid laminar element with opposed edges of said spaced-apart air chambers on opposite sides of the common longitudinal axis being formed by joined portions of said rigid and non-rigid laminar elements which are essentially straight lines.

14. The dynamic support as claimed in claim 13, wherein edges of said air chambers on opposite sides of said air chambers are formed by joined portions of said rigid and non-rigid laminar elements which are essentially arched joining lines.

15. The dynamic support device as claimed in claim 14, wherein the arched joining lines are substantially of ogive shape.

16. The dynamic support device as claimed in claim 14, wherein said non-rigid laminar elements are formed of an elastic material.

* * * * *